US008892002B2

(12) United States Patent
Sato

(10) Patent No.: US 8,892,002 B2
(45) Date of Patent: Nov. 18, 2014

(54) IMAGE FORMING APPARATUS HAVING PHOTOSENSITIVE DRUM MOVING MECHANISM

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 295 days.

(21) Appl. No.: 13/432,580

(22) Filed: Mar. 28, 2012

(65) Prior Publication Data

US 2012/0328327 A1 Dec. 27, 2012

(30) Foreign Application Priority Data

Jun. 27, 2011 (JP) ..... 2011-141601

(51) Int. Cl.
*G03G 21/18* (2006.01)

(52) U.S. Cl.
USPC ..... 399/112

(58) Field of Classification Search
CPC ..... G03G 15/0105; G03G 15/0131; G03G 15/0136; G03G 15/0184; G03G 15/0189; G03G 15/1094; G03G 21/1633; G03G 2215/0103; G03G 2215/0119; G03G 2215/0122; G03G 2215/0125; G03G 2215/0141; G03G 2221/1603; G03G 2221/183
USPC ..... 399/110, 111, 112, 299, 302, 303
See application file for complete search history.

(56) References Cited

U.S. PATENT DOCUMENTS

| | | | | |
|---|---|---|---|---|
| 7,664,428 | B2 | 2/2010 | Kei | |
| 2009/0092412 | A1 | 4/2009 | Kei | |
| 2009/0142092 | A1 * | 6/2009 | Sato | 399/111 |
| 2010/0166462 | A1 * | 7/2010 | Igarashi | 399/155 |
| 2011/0311269 | A1 * | 12/2011 | Murooka | 399/110 |
| 2012/0328325 | A1 | 12/2012 | Sato | |
| 2012/0328326 | A1 | 12/2012 | Sato | |

FOREIGN PATENT DOCUMENTS

| | | |
|---|---|---|
| JP | 2009-092914 | 4/2009 |
| JP | 2010-244071 | 10/2010 |

* cited by examiner

*Primary Examiner* — Robert Beatty
(74) *Attorney, Agent, or Firm* — Banner & Witcoff, Ltd.

(57) ABSTRACT

A holder is movable in a horizontal direction between an internal position within the main casing and an external position outside of a main casing. The holder has a first opening extending in the horizontal direction. A drum unit is configured to be held by the holder and is movable in a vertical direction with respect to the holder. The drum unit includes a photosensitive drum having an axis extending in an axial direction, a first end portion and a second end portion opposite to the first end portion in the axial direction. A particular pressure member is positioned in confrontation with the drum unit and urges the first end portion upward through the first opening to permit the photosensitive drum to be in contact with an endless belt when the holder is in the internal position.

10 Claims, 7 Drawing Sheets

IMAGE FORMING APPARATUS HAVING PHOTOSENSITIVE DRUM MOVING MECHANISM

CROSS REFERENCE TO RELATED APPLICATION

This application claims priority from Japanese Patent Application No. 2011-141601 filed Jun. 27, 2011. The entire content of the priority application is incorporated herein by reference.

TECHNICAL FIELD

The present invention relates to an image forming apparatus such as a color laser printer.

BACKGROUND

As an electro-photographic type color laser printer, a tandem type color laser printer is known in which a plurality of photosensitive drums are juxtaposed with each other for the color of yellow, magenta, cyan and black.

In a conventional tandem type color laser printer, a belt unit having an endless belt is provided and photosensitive drums juxtaposed with each other are positioned above and in contact with the endless belt.

According to the conventional color printer, each process cartridge accommodating each photosensitive drum is detachably attached to a cartridge tray. The cartridge tray is inserted into an interior of a main casing of the printer while a door is opened, and is positioned above the endless belt. Then, a pressure member positioned above each process cartridge is pivotally moved downward in interlocking relation to the closing movement of the door. The main casing has a positioning portion for positioning the process cartridges relative to the endless belt and the main casing as a result of pressure application from the pressure members. Thus, each pressure member presses each process cartridge downward whereupon each photosensitive drum is brought into contact with the endless belt, and positioning of each photosensitive drum with respect to the endless belt and the main casing is attained.

Japanese Patent Application Publication 2010-244071 discloses a tandem type color printer in which photosensitive drums are positioned below an intermediate transfer belt in a form of an endless belt, and each photosensitive drum is configured to contact the intermediate transfer belt.

According to the color printer disclosed in '071 publication, a plurality of process cartridges each accommodating each photosensitive drum are positioned below the belt unit. Each photosensitive drum has an upper peripheral part exposed to the intermediate transfer belt through each process cartridge. Thus, each photosensitive drum is in contact with the intermediate transfer belt from below.

SUMMARY

In the tandem type color printer in which the photosensitive drums are positioned below the endless belt, the process cartridges must be lifted upward for positioning against gravity when the pressure member is used for pressing the process cartridge. Hence, if a pressuring region of the pressure member for pressing the process cartridge is remote from the belt in a vertical direction, a contact region and positioning of the photosensitive drum with respect to the belt may become instable. Such instability may be accelerated by external factor such as vibration and friction with the belt during image forming operation, and consequently, blur of output image may occur.

In view of the foregoing, it is an object of the present invention to provide an image forming apparatus capable of bringing a photosensitive drum into stable contact with a belt or a positioning portion provided in a main casing even if the photosensitive drum is positioned below a belt unit.

In order to attain the above and other objects, the present invention provides an image forming apparatus including a main casing, a holder, an endless belt, a drum unit, and a particular pressure member. The holder is movable in a horizontal direction between an internal position within the main casing and an external position outside of the main casing. The holder has a first opening extending in the horizontal direction. The endless belt is disposed above the holder that is in the internal position. The drum unit is configured to be held by the holder and is movable in a vertical direction with respect to the holder. The drum unit includes a photosensitive drum having an axis extending in an axial direction, a first end portion and a second end portion opposite to the first end portion in the axial direction. The particular pressure member is positioned in confrontation with the drum unit and urges the first end portion upward through the first opening to permit the photosensitive drum to be in contact with the endless belt when the holder is in the internal position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
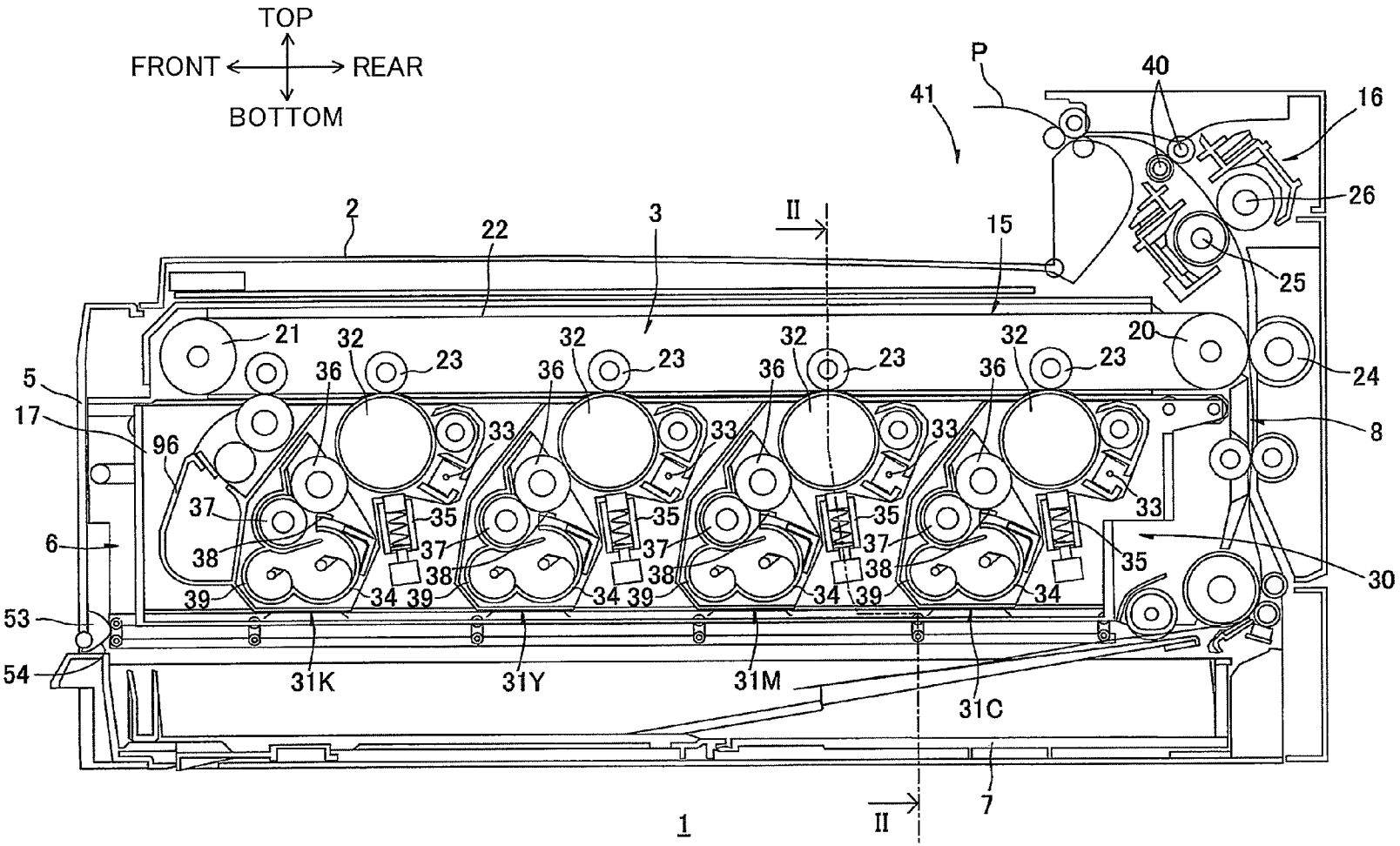
FIG. 1 is a cross-sectional side view of a color printer according to one embodiment of the present invention.

An image forming apparatus according to one embodiment of the present invention will be described while referring to FIGS. 1 through 7 wherein like parts and components are designated by the same reference numerals to avoid duplicating description.

1. Overall Structure of Color Printer

As shown in FIG. 1, the image forming apparatus according to the first embodiment is a horizontal intermediate transfer type color printer 1.

The color printer 1 includes a main casing 2 having an inner casing 51 for retaining an image forming unit 3 therein. Within the main casing 2, the image forming unit 3 and a sheet supply unit 4 are provided. The sheet supply unit 4 serves to supply sheets of paper P to the image forming unit 3.

(1) Main Casing

The main casing 2 has a box shape that is substantially rectangular in a side view. The main casing 2 has a front wall in which a main opening 6 is formed. The main opening 6 provides communication between the interior and exterior of the main casing 2. A front cover 5 is provided on the front wall so as to be pivotally movable about a lower end thereof. The front cover 5 is movable between a closed position and an open position. In the open position, an upper end of the front cover 5 is spaced apart from the main casing 2 and opens the main opening 6, while, in the closed position, the upper end of the front cover 5 is in abutment with the main casing 2 and closes the main opening 6.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 5 is provided (left side in FIG. 1) will be referred to as the front side of the color printer 1, and a side opposite to the front side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 7 for accommodating sheets of paper P therein. The sheet supply tray 7 is disposed at a bottom section of the main casing 2. The sheet supply tray 7 is detachably mounted in the main casing 2. A sheet supply path 8 is defined in the main casing 2. The sheet supply path 8 extends from a rear portion of the sheet supply tray 7 toward the image forming unit 3 (i.e. toward a position between a belt unit 15 (described later) and a secondary transfer roller 24 (described later)).

After the sheets P accommodated in the sheet supply tray 7 are separated by various rollers on a sheet-by-sheet basis, each separated sheet P is conveyed to the sheet supply path 8. While being guided by the sheet supply path 8, the sheet P is conveyed to the image forming unit 3.

(3) Image Forming Unit

The image forming unit 3 is disposed above the sheet supply unit 4. The image forming unit 3 includes a process unit 17, a belt unit 15, and a fixing unit 16.

(3-1) Process Unit

Within the main casing 2, the process unit 17 is disposed in an accommodating region 30 defined below the belt unit 15 and above the sheet supply unit 4.

The process unit 17 retains four process cartridges 31 corresponding to each color therein. Further, the process unit 17 is slidably movable in the frontward/downward direction between an internal position (FIGS. 1 and 7) in which the process unit 17 is positioned in the accommodating region 30 and an external position (FIG. 6) in which the process unit 17 is pulled outward of the main casing 2 when the front cover 5 is in the open position.

Four process cartridges 31 are juxtaposedly arrayed with and spaced apart from each other in the frontward/downward direction. More specifically, a black process cartridge 31K, a yellow process cartridge 31Y, a magenta process cartridge 31M, and a cyan process cartridge 31C are aligned in this order from front to rear.

Further, each process cartridge 31 includes a photosensitive drum 32, a Scorotron charger 33, and a developing unit 34.

The photosensitive drum 32 is cylindrical in shape extending in a rightward/leftward direction. The photosensitive drum 32 is rotatably supported to the process cartridges 31.

The Scorotron charger 33 is disposed diagonally below and rearward of the corresponding photosensitive drum 32, and confronts but does not contact the photosensitive drum 32.

The developing unit 34 is disposed diagonally below and frontward of the corresponding photosensitive drum 32. The developing unit 34 includes a developing roller 36.

The developing roller 36 is rotatably supported in an upper end of the corresponding developing unit 34. An upper rear edge of the developing roller 36 is exposed through an upper edge of the developing unit 34 and contacts the corresponding photosensitive drum 32 from below.

The developing unit 34 also includes a supply roller 37 for supplying toner to the corresponding developing roller 36 and a thickness-regulating blade 38 for regulating the thickness of the toner supplied to the developing roller 36. Further, the developing unit 34 includes a toner accommodating portion 39 for accommodating toner for a corresponding color therein. The toner accommodating portion 39 is disposed below the supply roller 37.

Further, the process unit 17 is provided with four LED units 35 in one-to-one correspondence with the four process cartridges 31.

The LED unit 35 is disposed rearward of the corresponding developing unit 34. Further, the LED unit 35 confronts the corresponding photosensitive drum 32 from below. The LED unit 35 is adapted to expose a surface of the corresponding photosensitive drum 32 based on image data.

Figure 2:
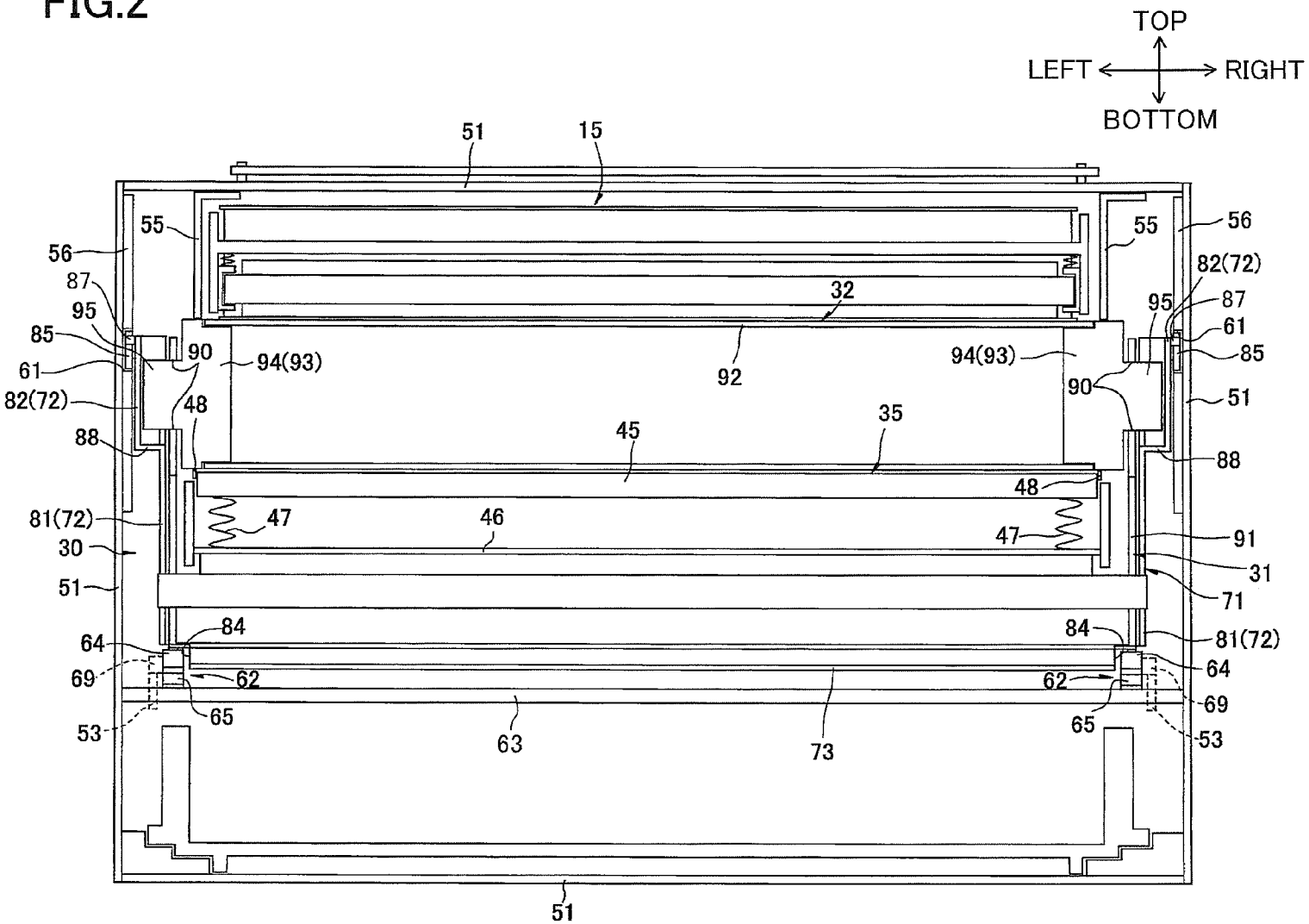
FIG. 2 is a cross-sectional view taken along the line II-II of FIG. 1.

As shown in FIG. 2, each LED unit 35 includes an LED array accommodating portion 46 and an LED array 45.

The LED array accommodating portion 46 is formed in a generally rectangular frame shape having a bottom wall and elongated in the rightward/leftward direction.

The LED array 45 is formed in an elongated beam shape extending in the rightward/leftward direction. The LED array 45 integrally retains a plurality of LEDs arrayed in the rightward/leftward direction. The LED array 45 has a lower portion that is accommodated in an upper portion of the LED array accommodating portion 46. The LED array 45 is movable relative to the LED array accommodating portion 46. The LED array 45 is resiliently supported to the bottom wall of the LED array accommodating section 46 by a pair of right and left compression springs 47 positioned between the bottom wall of the LED array accommodating portion 46 and the LED array 45.

The LED array 45 has right and left ends, each having an LED positioning member 48 for positioning the LED array 45 relative to the corresponding photosensitive drum 32.

Each LED positioning member 48 is formed in a plate shape that is substantially rectangular in a side view. The LED positioning members 48 are arranged to slightly protrude upward from the respective right and left edges of the LED array 45. The LED positioning members 48 are urged upward by the compression springs 47, thereby contacting the corresponding photosensitive drum 32 from below through a rear opening of a cartridge frame 91 described later. Hence, The LED array 45 is subjected to positioning relative to the photosensitive drum 32 such that the LED array 45 is in confrontation with the photosensitive drum 32 at a regular interval therebetween (at a distance corresponding to a protruding length of the LED positioning members 48) even if the photosensitive drum 32 is moved in a upward/downward direction as will be described later.

(3-2) Belt Unit

As shown in FIG. 1, the belt unit 15 is disposed in a topmost portion of the main casing 2.

The belt unit 15 includes a drive roller 20, a follow roller 21, an intermediate transfer belt 22, and four primary transfer rollers 23.

The drive roller 20 and the follow roller 21 are in confrontation with and spaced apart from each other in the frontward/rearward direction.

The intermediate transfer belt 22 is an endless belt. The intermediate transfer belt 22 is stretched around the drive roller 20 and the follow roller 21. When the drive roller 20 is driven to rotate, the intermediate transfer belt 22 circulates such that a lower portion of the intermediate transfer belt 22 moves in a rearward direction.

The primary transfer rollers 23 are juxtaposed with and spaced apart from each other in the frontward/rearward direction. The primary transfer rollers 23 are disposed so as to confront the corresponding photosensitive drum 32 with the lower portion of the intermediate transfer belt 22 interposed therebetween.

The secondary transfer roller 24 is disposed rearward of the belt unit 15.

The secondary transfer roller 24 confronts the drive roller 20 of the belt unit 15 with interposing the intermediate transfer belt 22 therebetween.

(3-2) Fixing Unit

The fixing unit 16 is disposed above the secondary transfer roller 24. The fixing unit 16 includes a heating roller 25 and a pressure roller 26 in confrontation with the heating roller 25.

(3-3) Image Forming Operations (3-3-1) Developing Operation

The toner accommodated in the toner accommodating section 39 of the developing unit 22 is supplied to the supply roller 37, and then to the developing roller 36.

As the developing roller 36 rotates, the thickness-regulating blade 38 regulates the toner carried on the surface of the developing roller 36 to a prescribed thickness, so that the developing roller 36 carries a uniform thin layer of toner thereon.

The toner supplied to the developing roller 36 is positively tribocharged between the thickness-regulating blade 38 and the developing roller 36.

In the meantime, the Scorotron charger 33 applies uniform charge of positive polarity to a surface of the corresponding photosensitive drum 32 as the photosensitive drum 32 rotates. Subsequently, the LED unit 35 exposes the surface of the corresponding photosensitive drum 32. An electrostatic latent image corresponding to an image to be formed on the sheet P is formed on the surface of the photosensitive drum 32.

As the photosensitive drum 32 continues to rotate, the positively charged toner carried on the surface of the developing roller 36 is supplied to the electrostatic latent image formed on the surface of the photosensitive drum 32, thereby developing the electrostatic latent image into a visible toner image through reverse development. Thus, the toner image is formed on the surface of the photosensitive drum 32.

(3-3-2) Transfer and Fixing Operations

The toner image formed on the surface of each photosensitive drum 32 through reverse development is primary-transferred onto the lower portion of the intermediate transfer belt 22 conveyed rearward, thereby forming a color image on the intermediate transfer belt 22.

When the color image formed on the intermediate transfer belt 22 reaches a confronting position where the intermediate transfer belt 22 confronts the secondary transfer roller 24 in association with circular movement of the intermediate transfer belt 22, the sheet P is supplied to the confronting position from the sheet supply unit 4 (alternatively, the manual sheet supply path 9) at a suitable timing of movement of the color image. As the intermediate transfer belt 22 continues to circularly move, the color image formed on the intermediate transfer belt 22 is secondary-transferred onto the sheet P.

The color image transferred onto the sheet P is thermally fixed to the sheet P by heat and pressure in the fixing unit 16, while the sheet P passes between the heating roller 25 and the pressure roller 26.

(4) Discharge

After the color image has been fixed to the sheet P in the fixing unit 16, the sheet P is discharged by discharge rollers 40 onto a discharge tray 41 formed on a top surface of the main casing 2.

2. Main Casing (1) Front Cover

The front cover 5 has an inner surface on which a pair of interlocking members 53 is provided. Each of the interlocking members 53 is provided at each lower end portion of each lateral end portion of the front cover 5 when the front cover 5 is at its closed position. Each interlocking member 53 protrudes rearward from the inner surface of the front cover 5, and is generally triangular shaped whose apex portion is positioned rearmost when the front cover 5 is at its closed position.

More specifically, in FIG. 1, a vertical length of each interlocking member 53 is gradually decreased rearward, and its apex portion is at the rearmost side and vertically intermediate position of the interlocking member 53. The apex potion is rounded. Further, the upper and lower oblique lines function as a cam surface 54.

(2) Details of Main Casing

As shown in FIG. 2, within the main casing 2, the inner casing 51 is provided. The inner casing 51 is formed in a box-shape and made of a material having high rigidity, such as a steel plate. Further, within the inner casing 51, a pair of right and left first frames 55 and a pair of right and left second frames 56, a movable link member 64, and a linkage mechanism 62 are provided.

(2-1) First Frame

The pair of first frames 55 is disposed at an upper portion of the main casing 2. The right first frame 55 is disposed at a right side of the belt unit 15 and the left first frame 55 is disposed at a left side of the belt unit 15. Each first frame 55 is formed in a generally rectangular flat plate shape and elongated in the frontward/rearward direction.

The pair of first frames 55 is arranged spaced apart from each other with the belt unit 15 interposed therebetween such that the pair of first frames 55 confronts each photosensitive drum 32 in the upward/downward direction at a position outside of a sheet contacting region of each photosensitive drum 32 in the rightward/leftward direction. (Here, the sheet contacting region implies a region of the photosensitive drum 32 where the sheet P contacts.) Each first frame 55 has an upper end portion fixed to a top wall of the inner casing 51.

Each first frame 55 has a lower portion in which four drum positioning recesses 59 (FIG. 3) in one-to-one correspondence with the four photosensitive drum 32.

Each drum positioning recess 59 is a substantially U-shaped notch having a bottom open. More specifically, the drum positioning recess 59 is depressed upward from a lower edge of the first frame 55. The four drum positioning recesses 59 are arranged juxtaposed with and spaced apart from each other in the frontward/rearward direction. Upper portions of right and left ends of the photosensitive drum 32 are supported in the drum positioning recesses 59 formed in the right and left first frames 55.

(2-2) Second Frame

Each of the right and left second frames 56 is formed in a flat plate shape extending in the frontward/rearward direction along right and left side plates of the inner casing 51. Further, each second frame 56 extends in the upward/downward direction from a position of the upper end portion of the first frame 55 toward a position lower than the photosensitive drum 32.

Each second frame 56 is formed with a guide groove 61 for guiding sliding movement of the process unit 17.

The guide groove 61 has a sufficient vertical length capable of receiving rollers 85 (described later) provided at the process unit 17. The guide groove 61 extends linearly in the frontward/rearward direction and is formed across substantially the entire frontward/rearward length of the second frame 56.

The guide groove 61 has a front end portion provided with a retaining portion 60 having a vertical length smaller than a diameter of the roller 85, and a roller 50. A lower side of the front end portion of the guide groove 61 is projected upward to form the retaining portion 60.

(2-3) Movable Link Member

Totally four leaf springs 66 as urging members are provided. Each leaf spring 66 is provided at the movable link member 64 and extends in the frontward/rearward direction. The leaf springs 66 are arrayed in the frontward/rearward direction, and neighboring leaf springs 66 are spaced away from each other.

Each leaf spring 66 has a pressure portion 67 in a plate shape and extending in the frontward/rearward direction, and a leg portion 68 integral with the pressure portion 67 and extending from each end of the pressure portion 67. The leg portion 68 is fixed to an upper surface of the movable link member 64. Thus, the pressure portion 67 is positioned in confrontation with and spaced away from the upper surface of the movable link member 64. Each pressure portion 67 provides resilient urging force directing upward against a force applied downward to the pressure portion 67.

The movable link member 64 is provided at each lateral end portion in the main casing 2 and is positioned above a fixed link member 63 (described later). That is two movable link members 64 spaced away from each other in the lateral direction extend in the frontward/rearward direction over an entire length of the main casing 2. Each movable link member 64 is an elongated beam shaped.

(2-4) Linkage Mechanism

Figure 3:
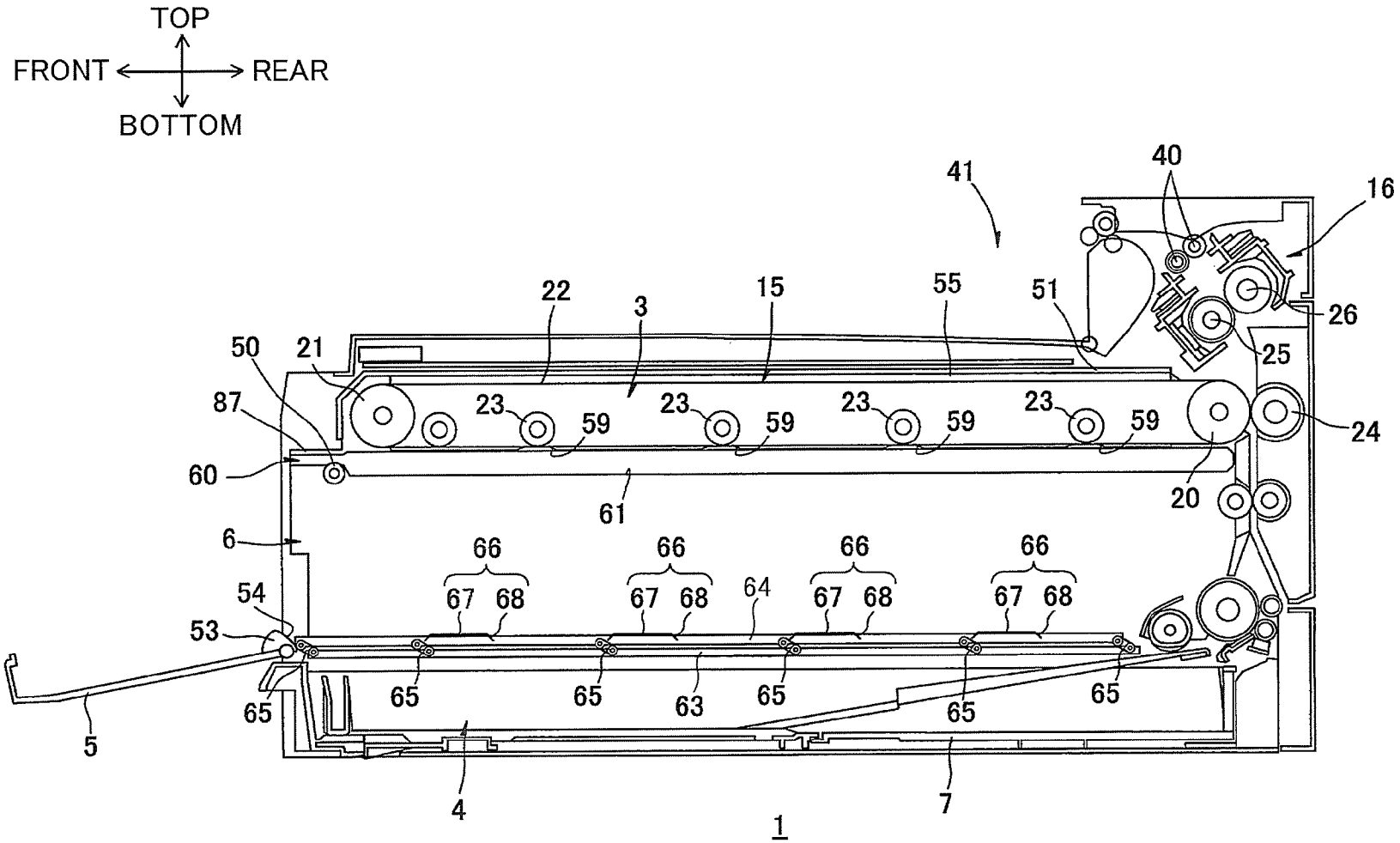
FIG. 3 is a cross-sectional view of the color printer particularly showing a linkage mechanism.

As shown in FIGS. 2 and 3, the linkage mechanism 62 is provided at a position below the accommodating region 30 where the process unit 17 is accommodated, and includes the fixed link member 63 (as a base portion) and joint members 65.

The fixed link member 63 is a flat plate shaped spanning between side walls of the inner casing 51 in the main casing 2, and extends over an entire length of the main casing 2 in the frontward/rearward direction.

Six joint members 65 are provided for each movable link member 64. The joint members 65 are arrayed in the frontward/rearward direction with a space between neighboring joint members 65. Each joint member 65 is oblong shaped in side view. One longitudinal end portion of each joint member 65 is pivotally movably connected to the fixed link member 63, and another longitudinal end portion thereof is pivotally movably connected to the movable link member 64. Thus, the joint member 65 is movable between an upstanding posture (FIG. 1) upstanding from the fixed link member 63 in which a major axis of the joint member extends in a vertical direction, and a droopy posture (FIG. 3) tilting forward from the upstanding posture.

Connecting portions of the joint members 65 to the fixed link member 63 are positioned at an equal interval, and connecting portions of the joint members 65 to the movable link member 64 are positioned at an equal interval. Thus, the movable link member 64 is movable relative to the fixed link member 63 maintaining parallelism therebetween.

More specifically, the movable link member 64 is spaced away from the fixed link member 63 and extends in a direction parallel to the fixed link member 63 when the joint members 65 are at their upstanding posture. In this case, the leaf springs 66 are positioned at pressing position for pressing the cartridge frame 91 of the process cartridge 31.

On the other hand, the movable link member 64 is moved toward the fixed link member 63 while maintaining parallelism therebetween when the joint members 65 are moving to the droopy posture. Thus, a gap between the movable link member 64 and the fixed link member 63 becomes small.

Then, the leaf springs 66 are positioned to their retracted position releasing pressing force to the cartridge frame 91 when the joint members 65 reach the droopy posture while maintaining parallelism between the movable link member 64 and the fixed link member 63. In this way, the movable link member 64 and the linkage mechanism 62 constitute a parallelogram linkage mechanism.

Among the six joint members 65, the other end portion of a front-most joint member 65 is connected to a front end portion of the movable link member 64, and the other end portion of a rearmost joint member 65 is connected to a rear end portion of the movable link member 64. Remaining four joint members 65 have their other end portions spaced away from each other at an intermediate portion of the movable link member 64, and each other end portion is positioned ahead of and adjacent to each leaf spring 66.

As shown in FIG. 2, the other end portion of the front-most joint member 65 is provided with a cylindrical boss 69 protruding laterally outwardly. The cylindrical boss 69 has a sufficient protruding length capable of being abutable on the interlocking member 53 of the front cover 5. That is, the boss 69 is positioned immediately rearward of the cam surface 54 of the interlocking member 53, while maintaining a contact between the boss 69 and the cam surface 54 at all times as shown in FIG. 3.

3. Process Unit

The process unit 17 includes a process frame 71 for integrally retaining the plurality of process cartridges 31 and the plurality of LED units 35 therein.

(1) Process Frame

Figure 5:
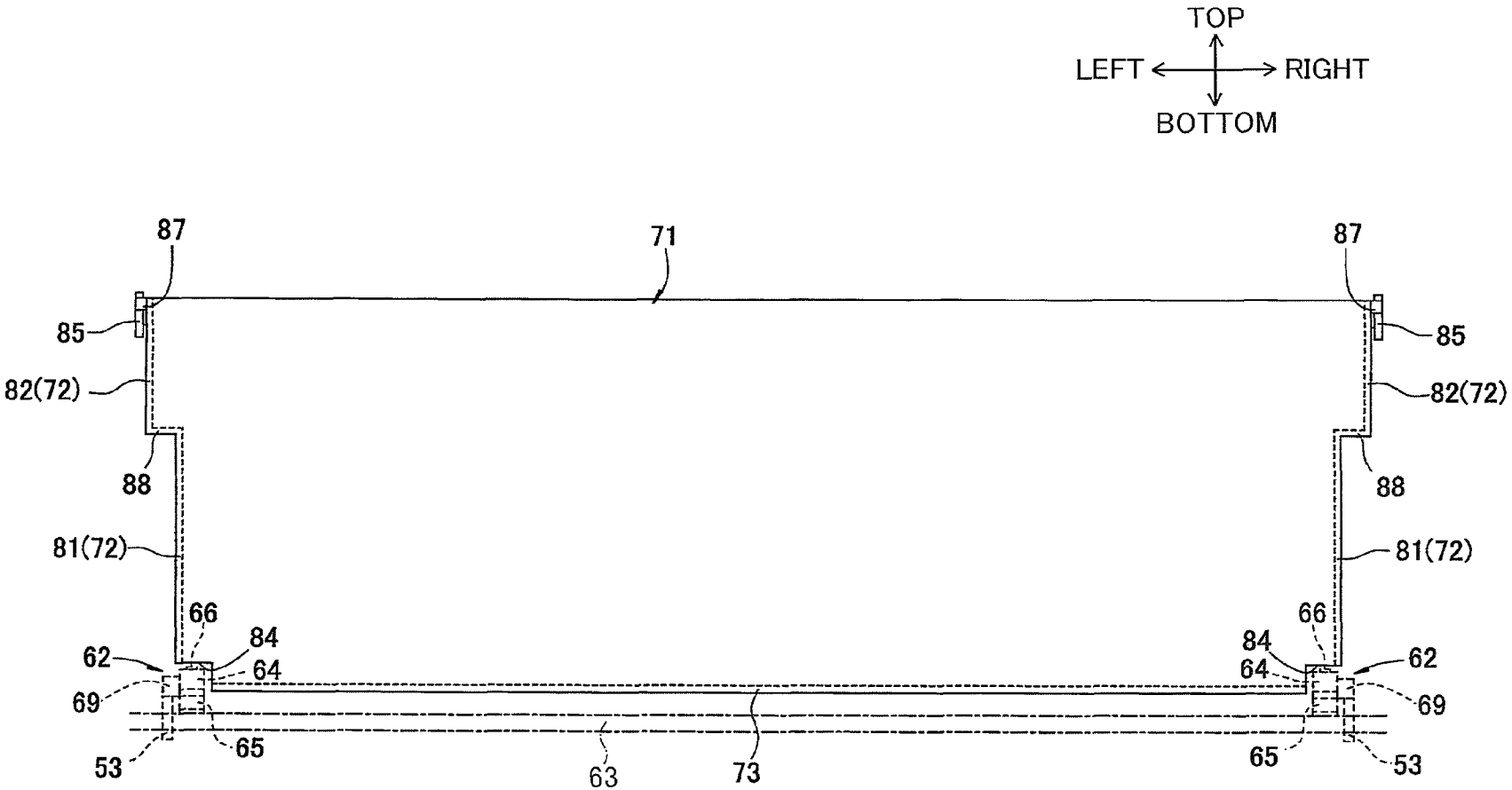
FIG. 5 is a front view of the process unit according to the embodiment.

As shown in FIGS. 2 and 5, the process frame 71 is formed in a generally rectangular frame shape with a bottom wall. The process frame 71 has a pair of right and left side plates 72, a bottom plate 73, and a front plate 74, and a rear plate 75. The pair of side plates 72, the bottom plate 73, the front plate 74, and the rear plate 75 are integral with one another. The side plates 72 are arranged in confrontation with and spaced apart from each other in the rightward/leftward direction. The bottom plate 73 bridges between lower edges of the side plates 72. The front plate 74 bridges between front edges of the side plates 72. The rear plate 75 bridges between rear edges of the side plates 72.

Each side plate 72 includes a first side plate 81, a second side plate 82, and a connecting plate 88.

The first side plate 81 is formed in a flat plate shape extending in the frontward/rearward direction and in the upward/downward direction. The first side plate 81 is formed with four shaft supporting notches 83 at positions corresponding to the four photosensitive drums 32 supported to the respective process cartridges 31. Each shaft supporting notch 83 is formed in a substantially U-shape having a top open. More specifically, the shaft supporting notch 83 is depressed downward from an upper edge of the first side plate 81 (FIG. 4).

The second side plate 82 is formed in a flat plate shape extending in the frontward/rearward direction and in the upward/downward direction. The second side plate 82 confronts an upper portion of the first side plate 81 in the rightward/leftward direction and is positioned laterally outward of the first side plate 81. More specifically, the second side plate 82 has a frontward/rearward length substantially equal to that of the first side plate 81. Further, the second side plate 82 has a vertical length smaller than that of the first side plate 81. Further, the second side plate 82 has an upper edge in flush with an upper edge of the first side plate 81 in the upward/downward direction and has a lower edge positioned downward of a lower edge of the shaft supporting notch 83.

Figure 4:
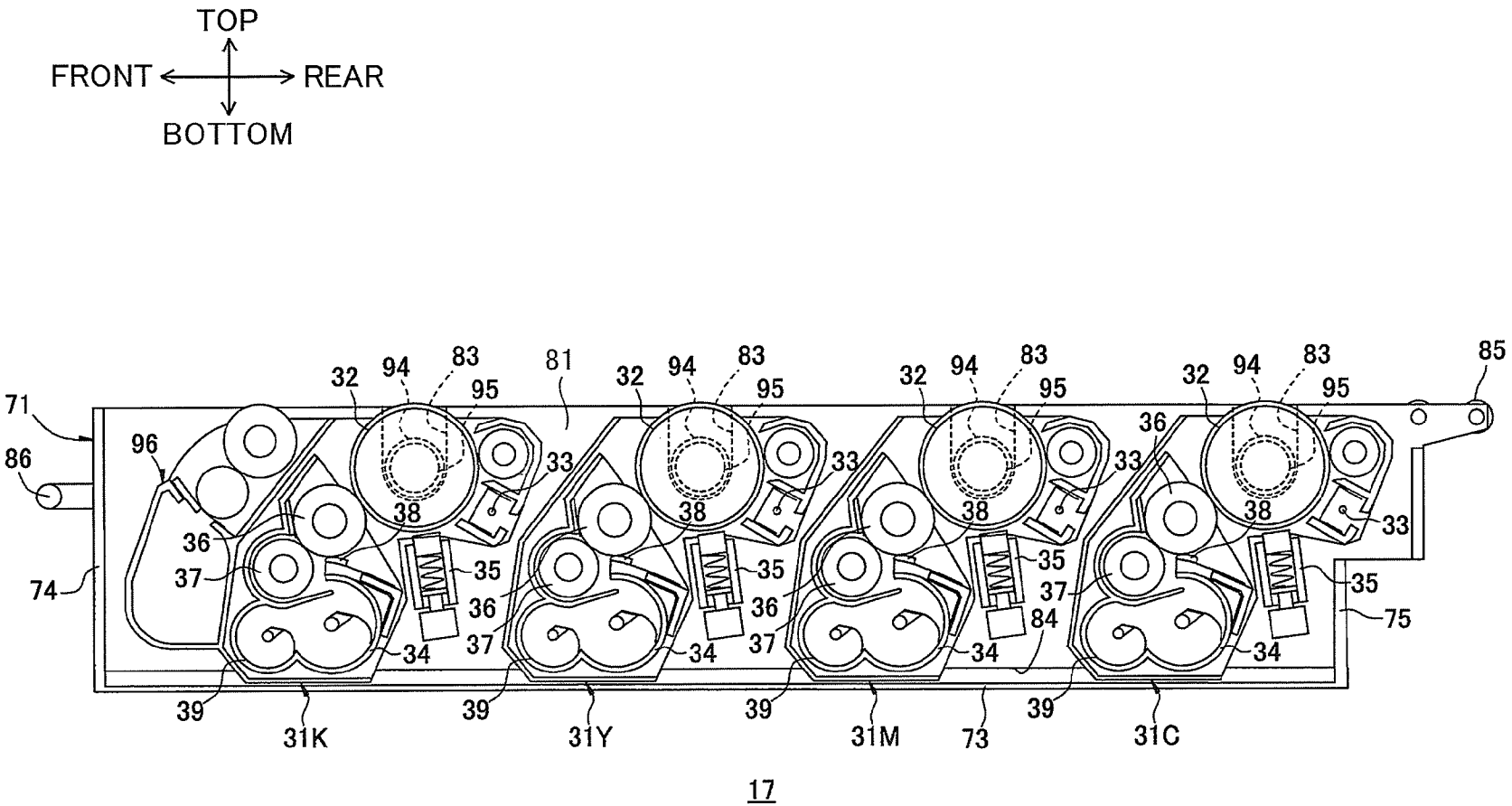
FIG. 4 is a cross-sectional side view of a process unit in the color printer according to the embodiment.

Further, the rollers 85 are supported to the second side plate 82 (FIGS. 2 and 4). More specifically, roller shafts (not shown) extend laterally outward from a laterally outer surface of the second side plate 82 at an upper rear end portion thereof, and the rollers 85 are rotatable about the roller shafts.

The second side plate 82 has an upper end portion provided with a guide rib 87 extending in the frontward/rearward direction over a length of the second side plate 82.

The connecting plate 88 is flat shaped extending laterally inward from the lower end portion of the second side plate 82 toward the first side plate 81 for connecting the first side plate 81 to the second side plate 82.

The front plate 74 is provided with a generally U-shaped hand grip portion 86. As shown in FIG. 4, each end of each arm of "U" is connected to the front surface of the front plate 74, and a bottom of the "U" is positioned ahead of the front plate 74. (For simplicity, the hand grip portion 86 is not shown in FIG. 5). Further, the process frame 71 is formed with a unit opening 84 (as a first opening portion).

The unit opening 84 is positioned at each lateral end portion of the lower end portion of the process frame 71, and is elongated in rectangular shape extending over a length of the process frame 71 in the frontward/rearward direction. More specifically, each lower edge of each side plate 72 is positioned higher than the bottom plate 73. Further, each lateral end of the bottom plate 73 is positioned laterally inward of the side plate 72. Further, each lateral end portion of a lower end portion of the front plate 74 and the rear plate 75 is formed with a notched portion having a profile in conformance with each lateral end of the bottom plate 73.

Further, the movable link member 64 and the linkage mechanism 62 are positioned in alignment with the unit opening 84 from below, when the process unit 17 is accommodated in the main casing 2.

(3) Process Cartridge

Each process cartridge 31 has a cartridge frame 91 formed in a top open box shape, and, within the cartridge frame 91, the photosensitive drum 32, the charger 33 (FIG. 1), and the developing unit 34 (FIG. 1) are provided.

The cartridge frame 91 has a pair of right and left side plates, each formed with a shaft supporting hole 90 at a position confronting the photosensitive drum 32 in the rightward/leftward direction.

As shown in FIG. 2, the photosensitive drum 32 includes a cylindrical drum body 92 and flange portions 93 fixedly (non-rotatably) fitted in respective right and left ends of the drum body 92.

The drum body 92 has a top layer made from a photosensitive layer with positive charging characteristic.

Each flange portion 93 is provided with an insertion portion 94 and a shaft portion 95 integral with the insertion portion 94. The insertion portion 94 is cylindrical in shape and press-fitted in the drum body 92. The shaft portion 95 is coaxial with the insertion portion 94 and is cylindrical in shape. The shaft portion 95 has an outer diameter smaller than that of the insertion portion 94 and substantially equal to an inner diameter of the shaft supporting hole 90 formed in the cartridge frame 91. The shaft portion 95 is supported in the shaft supporting hole 90 and rotatable relative to the cartridge frame 91.

With this configuration, the photosensitive drum 32 is exposed upward and is rotatably supported to the cartridge frame 91 via the shaft portions 95 of the flange portions 93.

Further, as shown in FIG. 5, the black process cartridges 31K is integrally provided with a belt cleaning unit 96 at a position frontward of the developing unit 34. The belt cleaning unit 96 is adapted for cleaning the intermediate transfer belt 22.

4. Mounting Operation of Process Cartridge Relative to Process Unit

Figure 6:
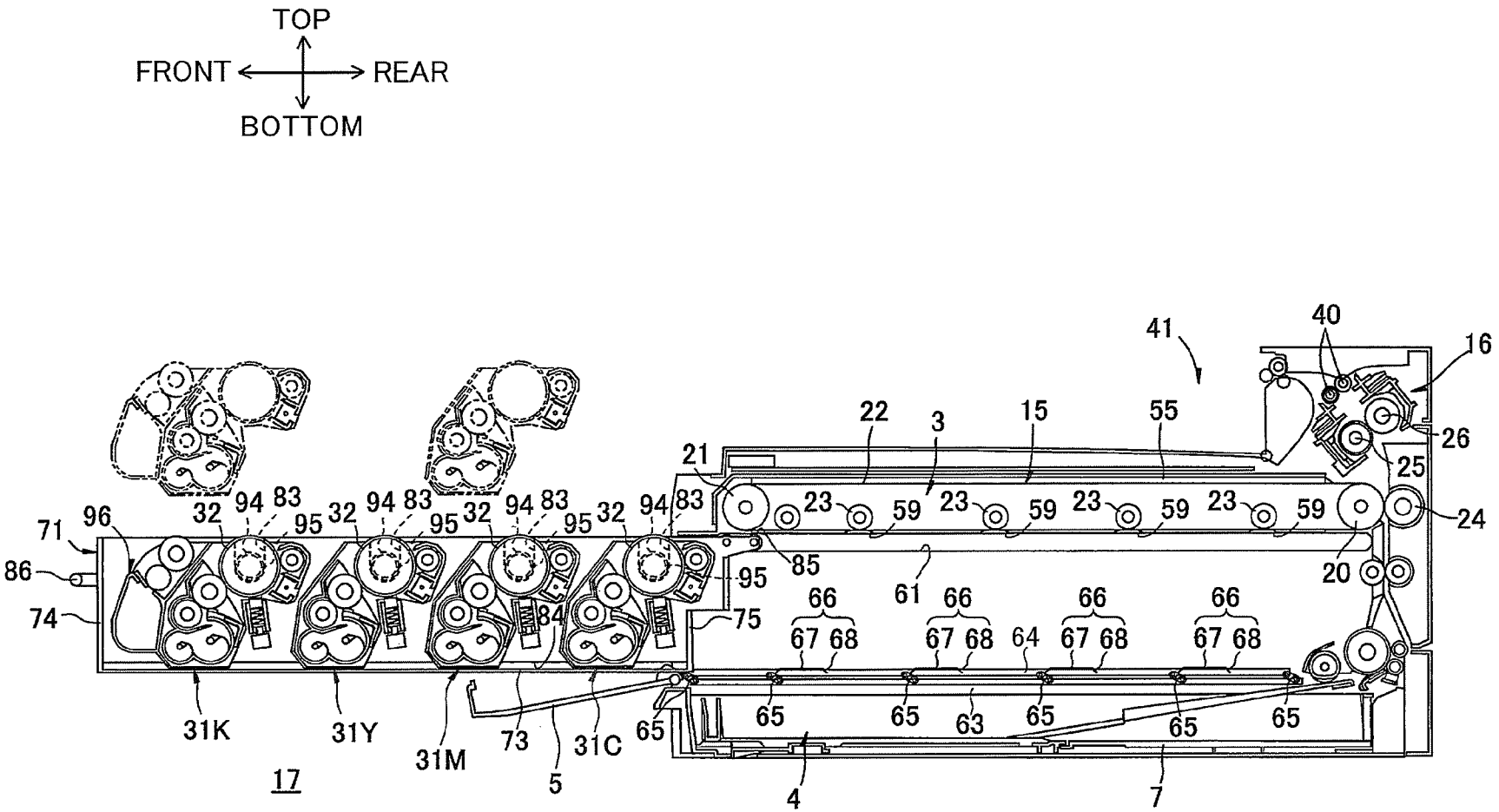
FIG. 6 is a cross-sectional side view for description of attachment and detachment of a process cartridge in the color printer according to the embodiment.

As shown in FIG. 6, a mounting operation of the process cartridges 31 relative to the process unit 17 is performed when the process unit 17 is in the external position where the process unit 17 is pulled outward of the main casing 2.

At this time, the front cover 5 is in the open position where the upper end (free end) of the front cover 5 is spaced apart from the main casing 2 and inclined forward and downward.

Further, the joint member 65 is at its droopy posture, so that the movable link member 64 is in retracted position.

Initially, the process cartridge 31 is positioned above the process unit 17. The process cartridge 31 has a posture such that the photosensitive drum 32 is positioned above the toner accommodating section 39.

Then, the process cartridge 31 is moved downward, so that the process cartridge 31 enters between the right and left side plates 72 of the process frame 71. When the process cartridge 31 is further moved downward, the shaft portions 95 of the flange portions 93 provided in the photosensitive drum 32 are inserted into the shaft supporting notches 83 formed in the first side plates 81 of the right and left side plates 72, and brought into abutment with the lower portions of the shaft supporting notches 83, respectively. Abutment of the shaft portions 95 with the lower portions of the shaft supporting notches 83 restricts further downward movement of the process cartridge 31. As a result, mounting of the process cartridge 31 in the process unit 17 is completed.

When the process cartridge 31 has been mounted in the process unit 17, each shaft portion 95 of the flange portion 93 is positioned such that a distal end portion of the shaft portion 95 is located between the first side plate 81 and the second side plate 82, that is, located above the connecting plate 88.

Further, lower lateral end portions of the process cartridge 31 is exposed downward to an outside through the unit openings 84 of the process unit 17.

5. Mounting Operation of Process Unit Relative to Main Casing

Figure 7:
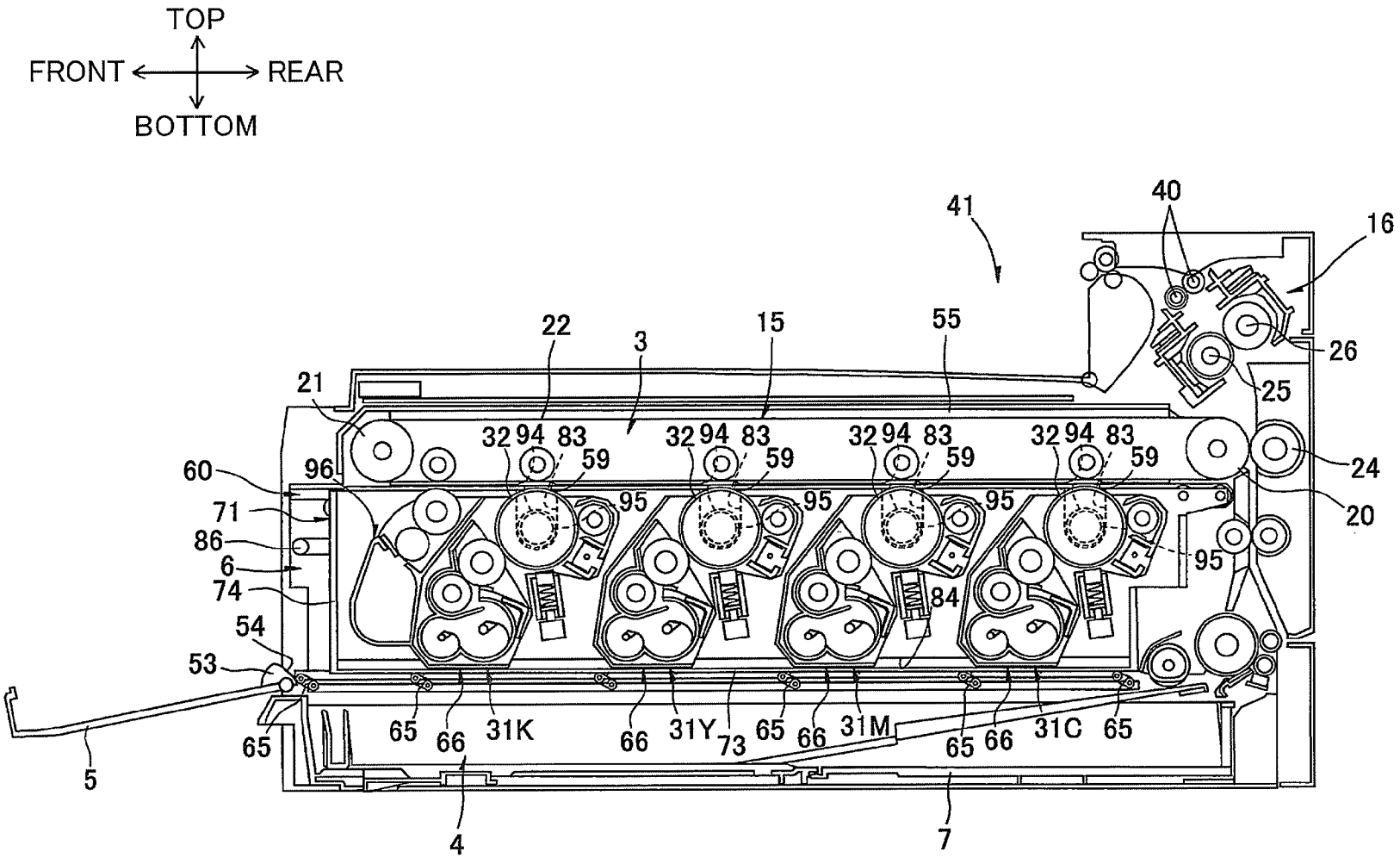
FIG. 7 is a cross-sectional side view for description of accommodating operation of the process unit in the color printer according to the embodiment.

As shown in FIGS. 6 and 7, a mounting operation of the process unit 17 relative to the main casing 2 is performed when all of four process cartridges 31 have been mounted in the process unit 17. That is, when all of four process cartridges 31 have been mounted in the process unit 17, the process unit 17 is moved to the internal position from the external position. When the process unit 17 is in the external position, the rollers 85 of each second side plate 82 of the side plate 72 are positioned in the front end portion of the corresponding guide groove 61 formed in the inner casing 51.

With this movement, the rollers 85 are rolled rearward along the guide groove 61. Further, the guide rib 87 is guided rearward on the roller 50 supported to the main casing. Then, when the process unit 17 is moved rearward until the rear side rollers 85 reach rear ends of the corresponding guide grooves 61, further rearward movement of the process unit 17 is restricted. As a result, movement of the process unit 17 to the internal position has been completed.

Further, in the process frame 71, the part of each process cartridge 31 exposed to the outside through the unit opening 84 is positioned directly above the corresponding pressure portion 67 of the leaf spring 66 through the unit opening 84.

At this time, the flange portions 93 of each photosensitive drum 32 is positioned below and spaced apart from the drum positioning recesses 59 formed in the first frames 55.

6. Pressing Operation by Linkage Mechanism

During pivotal movement of the front cover 5 from the open position to the closed position, the cam surface 54 of each interlocking member 53 pushes each boss 69 rearward and upward. Therefore, the boss 69 moves along the cam surface 54 upward in accordance with the pivotal movement of the front cover 5. Since each one end of the joint member 65 connected to the fixed link member 63 has been positioned rearward of each other end of the joint member 65 connected to the movable link member 64, each joint member 65 is pivotally moved rearward about each one end of each joint member 65. Thus, the boss 69 and the movable link member 64 are moved integrally rearward and upward.

Further, in accordance with the movement of the movable link member 64 rearward and upward, each pressure portion 67 of each leaf spring 66 is brought into contact with the cartridge frame 91 of the corresponding process cartridge 31 through the unit opening 84. In accordance with the further movement of the movable link member 64, the cartridge frame 91 is moved upward by the urging force of the leaf spring 66. Thus, process cartridges 31 are lifted upward.

When the front cover 5 is moved to the closed position, the boss 69 reaches a summit of the cam surface 54. In this case, each joint member 65 is at the upstanding position for maintaining the movable link member 64 at the pressing position.

The flange member 93 is entered into the positioning groove 59 of the first frame 55, and is in contact with the first frame 55 from below.

Thus, the outer peripheral surface of the photosensitive drum 32 is brought into contact with the intermediate transfer belt 22 of the belt unit 15 from below. Accordingly, positioning of the photosensitive drum 32 relative to the belt unit 15 can be achieved.

Incidentally, pressure release with respect to the cartridge frame 91 by means of the linkage mechanism 62 can be achieved by reversing the above-described procedure. That is, by moving the front cover 5 from the closed position to the open position, the boss 69 moves along the cam surface 54 downward, thereby moving the movable link member 64 frontward and downward. Because the cartridge frame 91 of the process cartridge 31 is positioned on the leaf spring 66, the photosensitive drum 32 is moved downward in accordance with the movement of the movable link member 64, and is moved away from the first frame 55.

As a result, urging force of the leaf spring to the cartridge frame 91 is shut off, and thereafter, the process unit 17 can be pulled outward by gripping and pulling the grip portion 86.

7. Advantageous Effects (1) According to the color printer 1, the leaf spring 66 is configured to upwardly urge the exposed portion of the process cartridge 13 exposed through the unit opening 84 of the process unit 17 by way of the pressure from the linkage mechanism 62 when the process unit 17 is in the internal position. Accordingly, the process cartridge 31 in its entirety can be lifted upward. Thus, the photosensitive drum 32 held to the process cartridge 31 can be brought into contact with the intermediate transfer belt 22 of the belt unit 15.

Further, since the unit opening 84 is formed in the process frame 71, urging force of the leaf spring 66 can be easily and efficiently transmitted to the process cartridge 31 with a simple construction.

Further, the leaf spring 66 can be positioned below the process unit 17 in the main casing 2. Here, by providing a highly rigid member, i.e., fixed link member 63 at the lower portion in the main casing 2, the highly rigid member can sustain reaction force from the leaf spring 66 generated by lifting the process cartridge 31 against gravity.

As a result, stabilized contact of the photosensitive drum 32 with the intermediate transfer belt 22 is attainable in a construction where the photosensitive drum 32 is positioned below the belt unit 15.

(2) Further, according to the color printer 1, there are provided the movable link member 64 supporting the leaf springs 66, and the linkage mechanism 62 configured to move the movable link member 64 between the pressing position and the retracting position. Therefore, the leaf springs 66 can be moved collectively. Consequently, pressure application or pressure release to and from the process cartridges 31 can be performed collectively.

(3) Further, the linkage mechanism 62 includes the fixed link member 63 disposed in confrontation with the movable link member 64, and the joint members 65 connecting the movable link member 64 to the fixed link member 63 and allowing the movable link member 64 to be moved with respect to the fixed link member 63. Therefore, movement of the movable link member 64 between the pressing position and the retracting position is attainable with a simple construction.

(4) Further, each joint member 65 is provided for each leaf spring 66. Therefore, local bending of the movable link member 64 at a position adjacent to the photosensitive drum 32 can be prevented, and all process cartridges 31 can be pressed stably by the leaf springs 66 when the movable link member 64 is moved to the pressing position.

(5) Further, the interlocking member 53 is configured to move the movable link member 64 from the retracted position to the pressing position in interlocking relation to the movement of the front cover 5 from the open position to the closed position. Therefore, simple operation for moving the front cover 5 to the closed position can realize movement of the movable link member 64.

In a conventional art, in order to avoid frictional contact between the photosensitive drums 32 of the process unit 17 and the intermediate transfer belt 22, the process unit 17 is positioned below and spaced apart from the belt unit 15 when moving, and the process unit 17 is entirely lifted upward to bring the photosensitive drum 32 into contact with the intermediate transfer belt 22 after the process unit 17 has reached the internal position.

However, in this case, for entirely lifting the process unit 17 upward against gravity, application of a greater force is required. Hence, operability is degraded.

In comparison with the conventional art, in the above-described embodiment, only the process cartridge 31 is lifted upward to bring the photosensitive drum 32 into contact with the intermediate transfer belt 22 after the process unit 17 has been horizontally moved. Therefore, in the configuration such that the process unit 17 is positioned below the belt unit 15, operability in positioning the photosensitive drums 32 relative to the belt unit 15 can be greatly improved.

Further, in a conventional color printer, there is a defect such that a process cartridge is required to be constantly urged upward, otherwise a photosensitive drum frictionally contacts a belt unit when a process unit is inserted into a main casing. In comparison with this conventional art, in the above-described embodiment, the process cartridge 31 is provided at a position spaced apart from the belt unit 15 (i.e. below the belt unit 15) by virtue of gravity. Hence, an urging unit for constantly urging the process cartridge 31 upward can be omitted.

While the present invention has been described in detail with reference to the present embodiments thereof, it would be apparent to those skilled in the art that various changes and modifications may be made therein without departing from the spirit of the present invention.

What is claimed is:

1. An image forming apparatus comprising:

a main casing;

a holder movable in a horizontal direction between an internal position within the main casing and an external position outside of the main casing, the holder having a first opening extending in the horizontal direction;

an endless belt disposed above the holder that is in the internal position;

a drum unit configured to be held by the holder and being movable in a vertical direction with respect to the holder, the drum unit including a photosensitive drum having an axis extending in an axial direction, a first end portion and a second end portion opposite to the first end portion in the axial direction; and a particular pressure member positioned in confrontation with the drum unit and urging the first end portion upward through the first opening to permit the photosensitive drum to be in contact with the endless belt when the holder is in the internal position, wherein the drum unit includes a plurality of drum units juxtaposedly arrayed with each other in a direction perpendicular to the axial direction, each of the plurality of drum units including a photosensitive drum of a plurality of photosensitive drums having an axis extending in an axial direction, a first end portion and a second end portion opposite to the first end portion in the axial direction, wherein the particular pressure member includes a plurality of particular pressure members each provided for each of the plurality of photosensitive drums and configured to urge upward the first end portion of a corresponding one of the plurality of photosensitive drums to permit the corresponding one of the photosensitive drums to be in contact with the endless belt when the holder is in the internal position, and wherein the image forming apparatus further comprises a link member movable between a pressing position and a retracted position, each of the plurality of particular pressure members being connected to the link member;

a linkage mechanism connected to the link member and configured to move the link member between the pressing position where each of the plurality of particular pressure members presses a corresponding first end portion and the retracted position where each of the plurality of particular pressure members releases pressing force to the corresponding first end portion;

a base portion provided in and fixed to the main casing and positioned below and in confrontation with the link member; and a plurality of joint members connecting the base portion to the link member and configured to move the link member toward and away from the base portion.

2. The image forming apparatus as claimed in claim 1, wherein the plurality of joint members are provided in association with the plurality of particular pressure members.

3. The image forming apparatus as claimed in claim 1, wherein each of the plurality of joint members has a first end portion pivotally movably connected to the base portion and a second end portion pivotally movably connected to the link member.

4. An image forming apparatus comprising:

a main casing, the main casing having an opening through which an interior and exterior of the main casing communicate with each other;

an opening/closing member pivotally movable between an open position opening the opening of the main casing and a closed position closing the opening of the main casing;

a holder movable in a horizontal direction between an internal position within the main casing and an external position outside of the main casing, the holder having a first opening extending in the horizontal direction;

an endless belt disposed above the holder that is in the internal position;

a drum unit configured to be held by the holder and being movable in a vertical direction with respect to the holder, the drum unit including a photosensitive drum having an axis extending in an axial direction, a first end portion and a second end portion opposite to the first end portion in the axial direction; and a particular pressure member positioned in confrontation with the drum unit and urging the first end portion upward through the first opening to permit the photosensitive drum to be in contact with the endless belt when the holder is in the internal position, wherein the drum unit includes a plurality of drum units juxtaposedly arrayed with each other in a direction perpendicular to the axial direction, each of the plurality of drum units including a photosensitive drum of a plurality of photosensitive drums having an axis extending in an axial direction, a first end portion and a second end portion opposite to the first end portion in the axial direction, wherein the particular pressure member includes a plurality of particular pressure members each provided for each of the plurality of photosensitive drums and configured to urge upward the first end portion of corresponding one of the plurality of photosensitive drums to permit the corresponding one of the photosensitive drums to be in contact with the endless belt when the holder is in the internal position, and wherein the image forming apparatus further comprises a link member movable between a pressing position and a retracted position, each of the plurality of particular pressure members being connected to the link member; and an interlocking member configured to move the link member from the retracted position to the pressing position in interlocking relation to movement of the opening/closing member from the open position to the closed position; and a linkage mechanism connected to the link member and configured to move the link member between the pressing position where each of the plurality of particular pressure members presses a corresponding first end portion and the retracted position where each of the plurality of particular pressure members releases pressing force to the corresponding first end portion.

5. The image forming apparatus as claimed in claim 4, wherein the linkage mechanism comprises:

a base portion provided in and fixed to the main casing and positioned below and in confrontation with the link member; and a plurality of joint members connecting the base portion to the link member and configured to move the link member toward and away from the base portion, wherein the interlocking member is provided at the opening/closing member and has a cam surface; and wherein each of the plurality of joint members has a first end portion pivotally movably connected to the base portion and a second end portion pivotally movably connected to the link member, wherein the link member has a front end portion provided with a boss to which the cam surface is abuttable, the boss extending from the second end portion of a frontmost joint member in the plurality of joint members.

6. An image forming apparatus comprising:

a main casing;

a holder movable in a horizontal direction between an internal position within the main casing and an external position outside of the main casing, the holder having a first opening extending in the horizontal direction and a second opening extending in the horizontal direction;

an endless belt disposed above the holder that is in the internal position;

a drum unit configured to be held by the holder and being movable in a vertical direction with respect to the holder, the drum unit including a photosensitive drum having an axis extending in an axial direction, a first end portion and a second end portion opposite to the first end portion in the axial direction, and the drum unit includes a plurality of drum units juxtaposedly arrayed with each other in a direction perpendicular to the axial direction, each of the plurality of drum units including a photosensitive drum of a plurality of photosensitive drums having an axis extending in an axial direction, a first end portion and a second end portion opposite to the first end portion in the axial direction;

a particular pressure member positioned in confrontation with the drum unit and urging the first end portion upward through the first opening to permit the photosensitive drum to be in contact with the endless belt when the holder is in the internal position;

a further pressure member positioned in confrontation with the drum unit and urging the second end portion upward through the second opening to permit the photosensitive drum to be in contact with the endless belt when the holder is in the internal position, the further pressure member including a plurality of further pressure members each provided for each of the plurality of photosensitive drums and configured to urge upward the second end portion of a corresponding one of the plurality of photosensitive drums to permit the corresponding one of the photosensitive drums to be in contact with the endless belt when the holder is in the internal position;

a link member movable between a pressing position and a retracted position, each of the plurality of further pressure members being connected to the link member; and a linkage mechanism connected to the link member and configured to move the link member between the pressing position where each of the plurality of further pressure member presses a corresponding second end portion and the retracted position where the each of the plurality of further pressure members releases pressing force to the corresponding second end portion, wherein the linkage mechanism comprises:

a base portion provided in and fixed to the main casing and positioned below and in confrontation with the link member; and a plurality of joint members connecting the base portion to the link member and configured to move the link member toward and away from the base portion.

7. The image forming apparatus as claimed in claim 6, wherein the plurality of joint members are provided in association with the plurality of further pressure members.

8. The image forming apparatus as claimed in claim 6, wherein each of the plurality of joint members has a first end portion pivotally movably connected to the base portion and a second end portion pivotally movably connected to the link member.

9. An image forming apparatus comprising:

a main casing having an opening through which an interior and exterior of the main casing communicates with each other;

an opening/closing member pivotally movable between an open position opening the opening of the main casing and a closed position closing the opening of the main casing;

a holder movable in a horizontal direction between an internal position within the main casing and an external position outside of the main casing, the holder having a first opening extending in the horizontal direction and a second opening extending in the horizontal direction;

an endless belt disposed above the holder that is in the internal position;

a drum unit configured to be held by the holder and being movable in a vertical direction with respect to the holder, the drum unit including a photosensitive drum having an axis extending in an axial direction, a first end portion and a second end portion opposite to the first end portion in the axial direction, and the drum unit includes a plurality of drum units juxtaposedly arrayed with each other in a direction perpendicular to the axial direction, each of the plurality of drum units including a photosensitive drum of a plurality of photosensitive drums having an axis extending in an axial direction, a first end portion and a second end portion opposite to the first end portion in the axial direction;

a particular pressure member positioned in confrontation with the drum unit and urging the first end portion upward through the first opening to permit the photosensitive drum to be in contact with the endless belt when the holder is in the internal position;

a further pressure member positioned in confrontation with the drum unit and urging the second end portion upward through the second opening to permit the photosensitive drum to be in contact with the endless belt when the holder is in the internal position, the further pressure member including a plurality of further pressure members each provided for each of the plurality of photosensitive drums and configured to urge upward the second end portion of a corresponding one of the plurality of photosensitive drums to permit the corresponding one of the photosensitive drums to be in contact with the endless belt when the holder is in the internal position;

a link member movable between a pressing position and a retracted position, each of the plurality of further pressure members being connected to the link member;

a linkage mechanism connected to the link member and configured to move the link member between the pressing position where each of the plurality of further pressure member presses a corresponding second end portion and the retracted position where the each of the plurality of further pressure members releases pressing force to the corresponding second end portion; and an interlocking member configured to move the link member from the retracted position to the pressing position in interlocking relation to movement of the opening/closing member from the open position to the closed position.

10. The image forming apparatus as claimed in claim 9, wherein the linkage mechanism comprises:

a base portion provided in and fixed to the main casing and positioned below and in confrontation with the link member; and a plurality of joint members connecting the base portion to the link member and configured to move the link member toward and away from the base portion, wherein the interlocking member is provided at the opening/closing member and has a cam surface, wherein each of the plurality of joint members has a first end portion pivotally movably connected to the base portion and a second end portion pivotally movably connected to the link member, and wherein the link member has a front end portion provided with a boss to which the cam surface is abuttable, the boss extending from the second end portion of a frontmost joint member in the plurality of joint members.

* * * * *